US011459851B2

(12) United States Patent
Aulia

(10) Patent No.: US 11,459,851 B2
(45) Date of Patent: Oct. 4, 2022

(54) RELIEVING HIGH ANNULUS PRESSURE USING AUTOMATIC PRESSURE RELIEF SYSTEM

(71) Applicant: Saudi Arabian Oil Company, Dhahran (SA)

(72) Inventor: Fahmi Aulia, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/002,476

(22) Filed: Aug. 25, 2020

(65) Prior Publication Data

US 2022/0065069 A1 Mar. 3, 2022

(51) Int. Cl.
*E21B 34/02* (2006.01)

(52) U.S. Cl.
CPC ..... *E21B 34/02* (2013.01)

(58) Field of Classification Search
CPC ..... E21B 33/03; E21B 33/0355; E21B 34/02; E21B 34/025; E21B 34/04
See application file for complete search history.

(56) References Cited

U.S. PATENT DOCUMENTS 4,703,774 A * 11/1987 Seehausen ..... E21B 33/0355 137/614.04
5,078,177 A * 1/1992 Tartaglia ..... F16K 17/0433 137/471
5,273,112 A 12/1993 Schultz
6,457,528 B1 10/2002 Staudt
7,905,251 B2 * 3/2011 Flanders ..... F17D 5/00 137/601.14
8,353,351 B2 1/2013 Carpenter et al.
10,174,584 B2 * 1/2019 Kajaria ..... E21B 34/02
10,745,991 B2 * 8/2020 Kajaria ..... F16K 3/02
2008/0156077 A1 * 7/2008 Flanders ..... E21B 33/03 73/49.6
2013/0126152 A1 * 5/2013 Banks ..... F16K 17/1606 166/53
2014/0151065 A1 * 6/2014 Stephenson ..... E21B 21/106 166/374
2015/0292297 A1 * 10/2015 Kajaria ..... F16K 17/16 166/250.01
2016/0201838 A1 * 7/2016 Flanders ..... F17D 1/08 137/12
2017/0002624 A1 * 1/2017 Hess ..... E21B 33/04
2017/0370153 A1 12/2017 Gahlawat et al.

(Continued)

FOREIGN PATENT DOCUMENTS

GB 2546100 7/2017
WO WO 2015147806 10/2015

OTHER PUBLICATIONS

PCT International Search Report and Written Opinion in International Appln. No. PCT/US2021/047472, dated Nov. 17, 2021, 16 pages.

*Primary Examiner* — Daniel P Stephenson
(74) *Attorney, Agent, or Firm* — Fish & Richardson P.C.

(57) ABSTRACT

A fluid conduit defines a fluid passage from a well annulus to a venting system. A first pressure safety valve is positioned within the fluid passage. The first pressure safety valve is configured to open at a first set pressure. A second pressure safety valve is fluidically connected in series with the first pressure safety valve. The second pressure safety valve is configured to open at a second set pressure.

16 Claims, 7 Drawing Sheets

(56) References Cited

U.S. PATENT DOCUMENTS

| | | | | |
|---|---|---|---|---|
| 2019/0219186 | A1* | 7/2019 | Fink | F16K 17/0473 |
| 2020/0025413 | A1* | 1/2020 | Lopez | F16K 17/003 |
| 2020/0149654 | A1* | 5/2020 | Cao | F16K 27/029 |
| 2021/0054697 | A1* | 2/2021 | Dokhon | E21B 33/138 |

* cited by examiner

RELIEVING HIGH ANNULUS PRESSURE USING AUTOMATIC PRESSURE RELIEF SYSTEM

TECHNICAL FIELD

This disclosure relates to pressure relief systems in a production or injection well.

BACKGROUND

In hydrocarbon production, a completed production or injection well includes a production/injection tubular and a casing (wellbore wall in the case of an open-hole completion). The production tubing and the casing define an annulus. This annulus is filled with fluids (gas, hydrocarbons, diesel, etc.) left over from well completion or added to help maintain well integrity.

SUMMARY

This disclosure describes technologies relating to automatically relieving high annulus pressure from a well.

An example implementation of the subject matter described within this disclosure is a pressure relief system with the following features. A fluid conduit defines a fluid passage from a well annulus to a venting system. A first pressure safety valve is positioned within the fluid passage. The first pressure safety valve is configured to open at a first set pressure. A second pressure safety valve is fluidically connected in series with the first pressure safety valve. The second pressure safety valve is configured to open at a second set pressure.

Aspects of the example pressure relief system, which can be combined with the pressure relief system alone or in combination, include the following. The second set pressure is greater than the first set pressure.

Aspects of the example pressure relief system, which can be combined with the pressure relief system alone or in combination, include the following. The first set pressure is substantially 1200 pounds per square inch gauge pressure and the second set pressure is substantially 1250 pounds per square inch gauge pressure.

Aspects of the example pressure relief system, which can be combined with the pressure relief system alone or in combination, include the following. The first pressure safety valve or the second pressure safety valve is a poppet style safety valve.

Aspects of the example pressure relief system, which can be combined with the pressure relief system alone or in combination, include the following. A cracking pressure of the first pressure safety valve and the second pressure safety valve are at substantially 97% of the first set pressure and the second pressure safety valve respectively.

Aspects of the example pressure relief system, which can be combined with the pressure relief system alone or in combination, include the following. A seating pressure of the first pressure safety valve and the second pressure safety valve are at substantially 90% of the first set pressure and the second pressure safety valve respectively.

An example implementation of the subject matter described within this disclosure is a method with the following features. An increase in pressure is received by a valve disk within a fluid conduit defining a flow passage fluidically coupled to a well annulus. The valve disk of a first pressure safety valve is lifted responsive to the received increase in pressure.

Aspects of the example method, which can be combined with the example method alone or in combination, include the following. The valve disk of the first pressure safety valve is seated in response to a decreased pressure.

Aspects of the example method, which can be combined with the example method alone or in combination, include the following. Pressure is communicated through the first pressure safety valve to a second safety valve. A valve disk of a second pressure safety valve is lifted responsive to the communicated pressure.

Aspects of the example method, which can be combined with the example method alone or in combination, include the following. The valve disk of the second pressure safety valve is seated in response to a decreased pressure.

Aspects of the example method, which can be combined with the example method alone or in combination, include the following. A pressure within the fluid conduit is reduced by manually venting the fluid conduit by a manual or actuated valve.

An example implementation of the subject matter described within this disclosure is a system with the following features. A wellbore includes an annulus defined by a wellbore casing and production tubing. A safe venting system includes a fluid conduit defining a fluid passage from a well annulus to a venting system. The safe venting system includes a poppet-style pressure safety valve positioned within the fluid passage. The poppet-style pressure safety valve configured to open at a set pressure.

Aspects of the example system, which can be combined with the example system alone or in combination, include the following. A cracking pressure of the poppet-style pressure safety valve is at substantially 97% of the set pressure.

Aspects of the example system, which can be combined with the example system alone or in combination, include the following. A seating pressure of first pressure safety valve is at substantially 90% of the set pressure.

Aspects of the example system, which can be combined with the example system alone or in combination, include the following. The poppet-style pressure safety valve is a first pressure safety valve and the set pressure is a first set pressure. The safe venting system further includes a second pressure safety valve fluidically connected in series with the first pressure safety valve. The second pressure safety valve is configured to open at a second set pressure.

Aspects of the example system, which can be combined with the example system alone or in combination, include the following. The second set pressure is greater than the first set pressure.

Aspects of the example system, which can be combined with the example system alone or in combination, include the following. A cracking pressure of the second pressure safety valve is at substantially 97% of the set pressure.

Aspects of the example system, which can be combined with the example system alone or in combination, include the following. A seating pressure of second pressure safety valve is at substantially 90% of the second set pressure.

Aspects of the example system, which can be combined with the example system alone or in combination, include the following. An additional fluid conduit directs the pressure from the poppet-style pressure safety valve to a closed venting system.

Aspects of the example system, which can be combined with the example system alone or in combination, include the following. An additional fluid conduit directs the pressure from the poppet-style pressure safety valve to an open venting system.

Particular implementations of the subject matter described in this disclosure can be implemented so as to realize one or more of the following advantages. The subject matter described herein can reduce the likelihood of a casing burst or a tubing collapse. The subject matter described herein can regulate annular pressure without the need for operator intervention.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

As operating conditions change within a well, the temperature of the fluid within the annulus of the well can change. Such changes in temperature can result in similar changes in pressure. If the pressure within the annulus becomes too high, then the production tubing within the well can collapse and be crushed. Such a situation requires an extensive workover to change out the crushed tubing.

This disclosure relates to a pressure relief system for a wellbore annulus. The system includes two poppet-style pressure safety valves (PSVs) in series that are biased to remain in a closed position until a pressure within the annulus rises above a specified set point. Once the annular pressure has risen above the specified set point, the pressure overcomes the bias in the PSVs and lifts the valve from the seat, allowing pressure to escape the annulus. The two PSVs have differing set pressures. The valve immediately fluidically connected to the annulus has a lower set pressure than the second PSV in the series. Once the pressure within the annulus has dropped below a second specified set point, lower than the original set point, the bias forces the valve closed against the valve seat. The pressure is routed to a safe place, such as a safe venting area, reservoir, or into a flare header.

Figure 1:
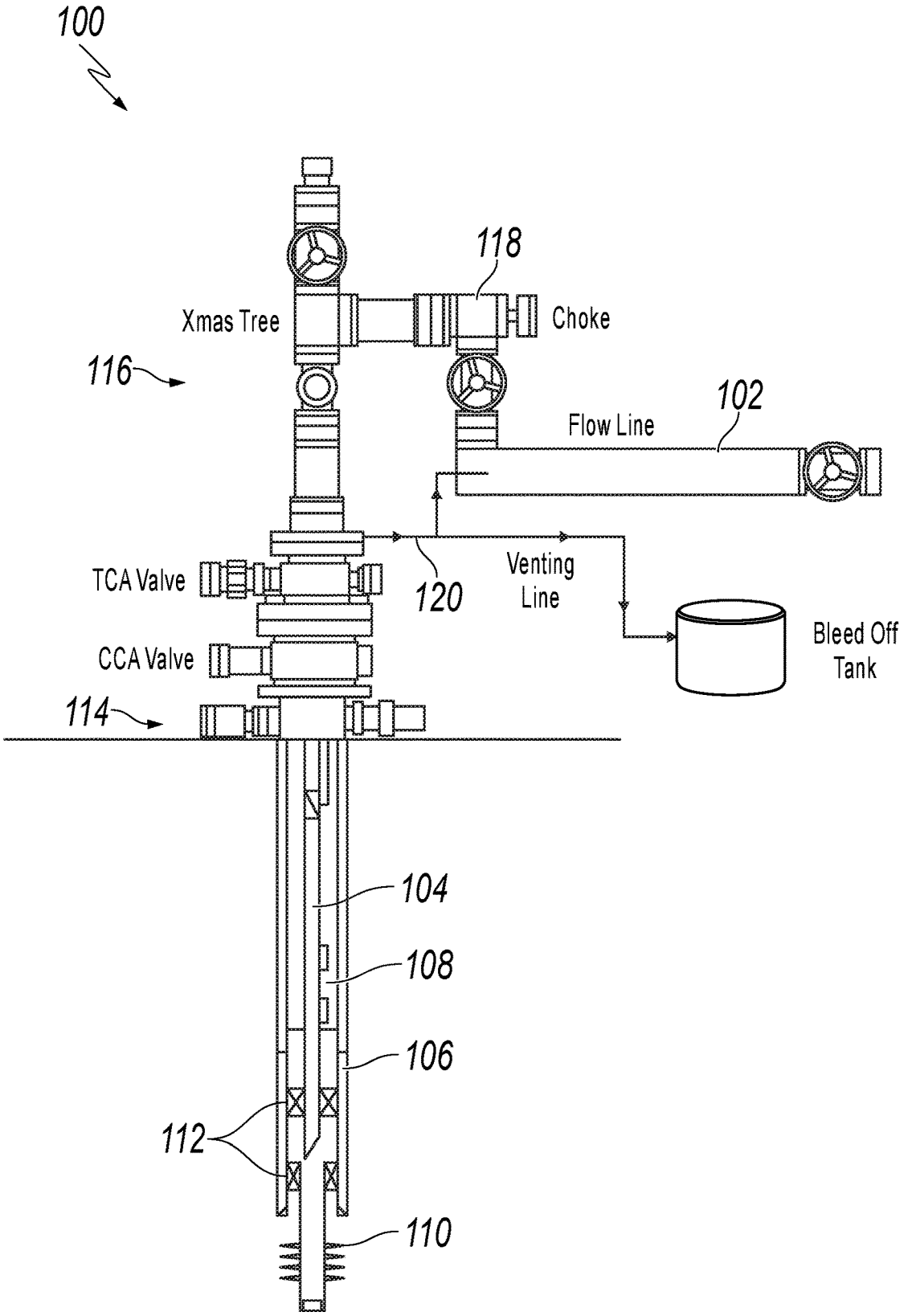
FIG. 1 is a side, partial cross-sectional diagram of an example well and flowline.

FIG. 1 is a side, partial cross-sectional diagram of an example well 100 and flowline 102. The well 100 includes a production tubing 104 and a casing 106. The space between the casing 106 and the tubing 104 and defined by the casing 106 and the tubing 104 is referred to as the annulus 108. At a downhole end of the well, perforations 110 allow hydrocarbons to flow from a geologic formation and into the production tubing. One or more packers 112 seal the annulus from the hydrocarbons. The portion of the annulus 108 uphole of the packers 112 is typically filled with a fluid of some kind, for example, gas, water, or diesel. At an uphole end of the well 100 is a wellhead 114 atop which is mounted a tree 116. The tree 116 includes various valves and fittings for controlling fluid communication within the well 100, for example, the choke 118 regulates hydrocarbon flow from the well 100 into a flowline 102. The flowline 102 directs the produced hydrocarbons to production facilities that can further condition, process, and/or store the produced hydrocarbons.

As production rates change, the temperature of the hydrocarbons flowing through the production tubing 104 changes. For example, the temperature during no-flow conditions is typically less than during full production (high-flow) conditions. This temperature change is communicated through the tubing 104 to the annulus 108. These temperature swings can cause changes in volume, pressure, or both, to the fluids within the annulus. Depending upon the fluid in the annulus, the pressure changes can be significant enough to damage the tubing 104, wellhead 114 components, or other well components. To reduce the risk of such damage occurring, an annular venting line 120 directs this excess pressure to a safe location. For example, the venting line can be directed to the flowline 102, a closed venting system, or an open venting system that vents to a safe location. A closed venting system can include a flare header or a bleed-off tank.

Figure 2A:
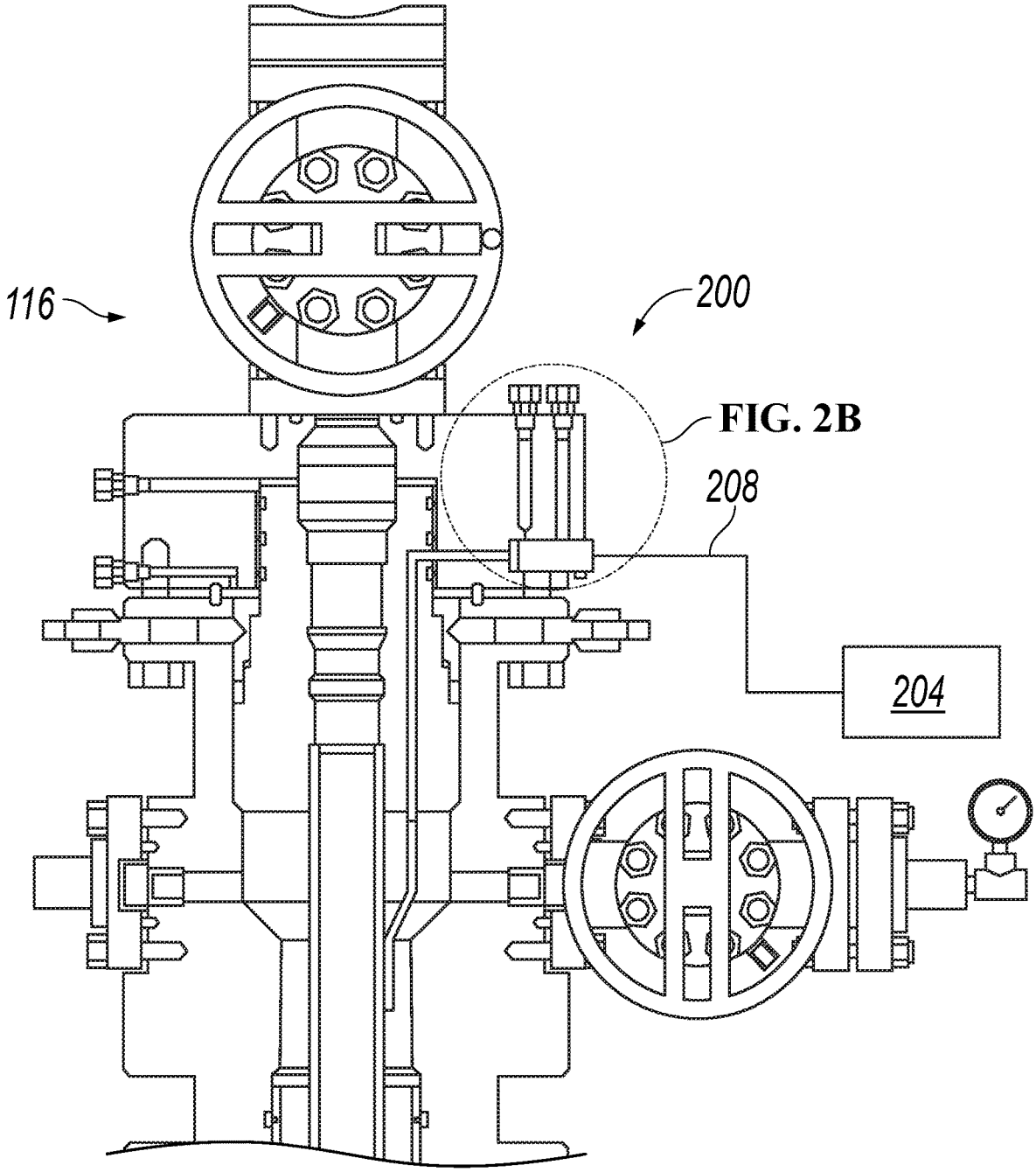
FIGS. 2A-2B are side, partial cross-sectional diagrams of an example annulus pressure relief system.
Figure 2B:
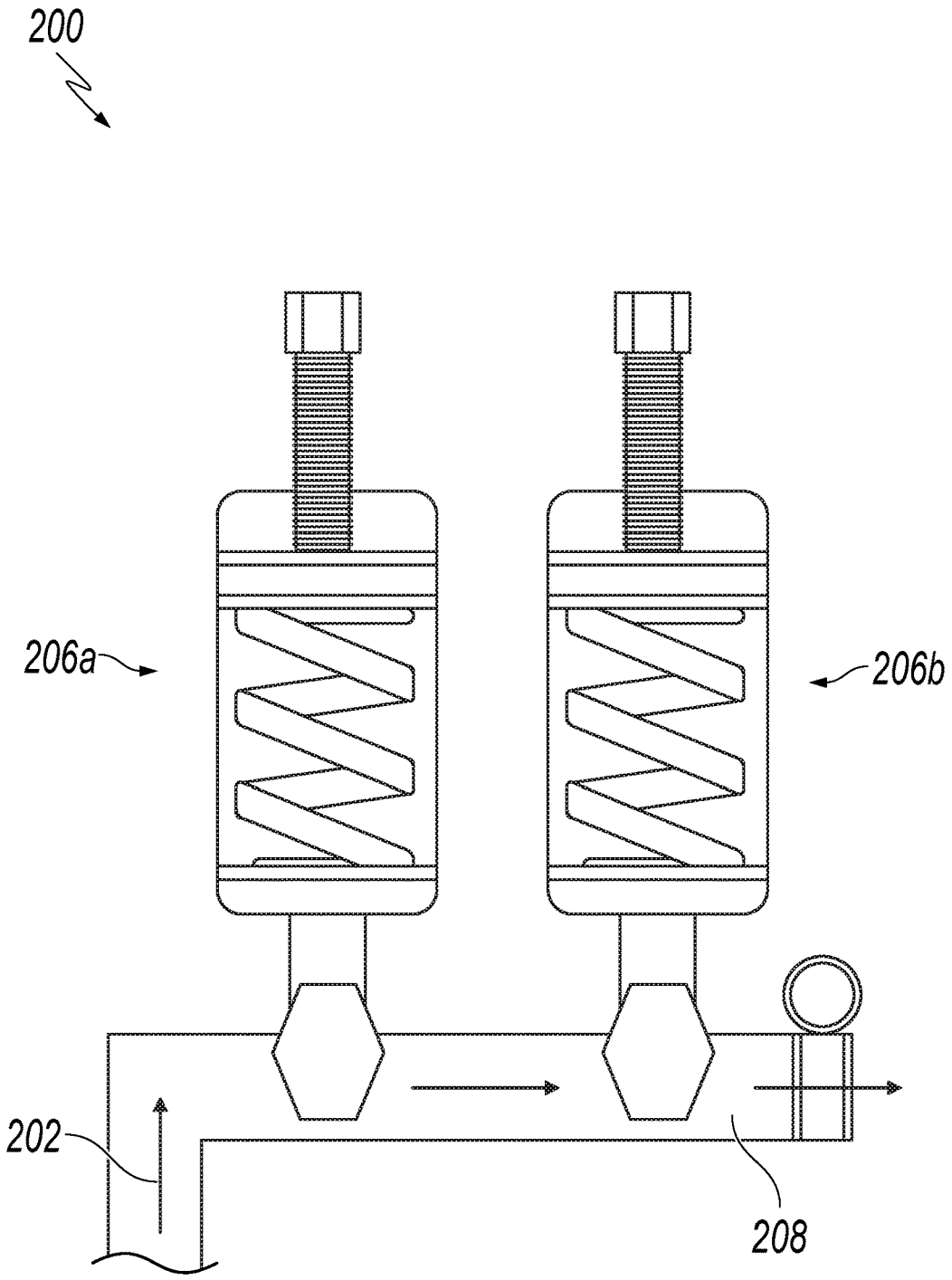

FIGS. 2A-2B are side, partial cross-sectional diagrams of an example annulus pressure relief system 200. The system 200 includes a fluid conduit 202 (such as the annular venting line 120) defining a fluid passage from a well annulus 108 (See FIG. 1) to a venting system 204. A first PSV 206*a* is positioned within the fluid passage. The first PSV 206*a* is configured to open at a first set pressure, for example substantially 1,200 pounds per square inch gauge pressure. Downstream of the first PSV 206*a* is a second PSV 206*b* fluidically connected in series with the first PSV 206*a*, the second PSV 206*b* configured to open at a second set pressure. In some implementations, the second set pressure is greater than the first set pressure. For example, in some implementations, the second set pressure is substantially 1,250 pounds per square inch gauge pressure. Downstream of the second PSV 206*b* is an additional fluid conduit 208 that directs the pressure from the second PSV 206*b* to an open venting system, a closed venting system, or the flowline 102.

While PSVs are calibrated to a "set" pressure, the "cracking" pressure, that is, the pressure when the valve disk begins to lift from the valve seat, is typically lower than the set pressure. For example, in some implementations, a cracking pressure of the first PSV 206*a* and the second PSV 206*b* are at substantially 97% of the first set pressure and the second set pressure respectively. Similarly, a "seating" pressure, that is, the pressure at which a valve disk is able to seal against a valve seat to re-establish a seal, is also typically lower than the set pressure. For example, in some implementations, a seating pressure of the first PSV 206*a* and the second PSV 206*b* can be at substantially 90% of their respective set pressures. As such, the first PSV 206*a* will likely crack and seat before the second PSV 206*b*.

Figure 3:
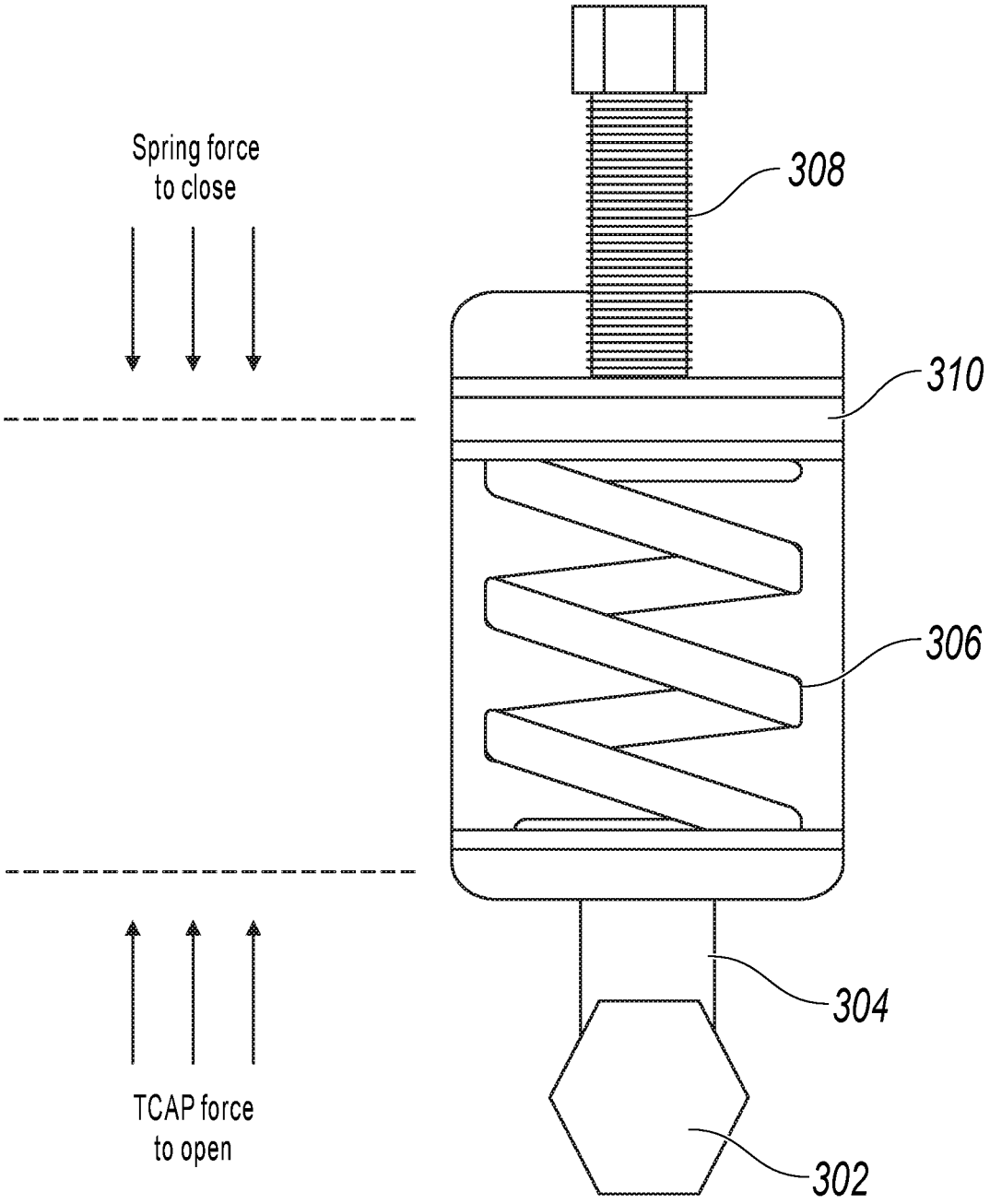
FIG. 3 is a side, cross-schematic diagram of an example poppet valve.

FIG. 3 is a side, cross-schematic diagram of an example poppet valve 206 that can be used as the first PSV 206*a*, the second PSV 206*b*, or both. The poppet valve 206 includes a valve disk 302 and a seat (not shown). The valve disk 302 rests against the seat to prevent flow through the valve 206, and the valve disk 302 lifts from the seat to allow flow through the valve 206. The disk is coupled to a biased piston 304. While illustrated as using a compression spring 306 to provide the bias, other mechanisms can be used to provide similar bias, such as tension springs, compressed gases, or diaphragms. On the end of the compression spring 306, opposite of the biased piston 304, is a set screw 308. The set screw 308 adjusts a plate 310 to pre-bias the compression spring 306. Adjusting this screw 308 adjusts the set pressure of the valve 206 by adjusting the position of the plate 310 and changing the amount of pre-compression that is applied to the compression spring. Poppet valves are one-way valves, meaning that the increased pressure on one side of the valve will open the valve, while pressure on the other side of the valve will not. While primarily described and illustrated as using poppet valves, the subject matter described herein can be applied using different types of PSVs, for example, pilot valves.

Figure 4A:
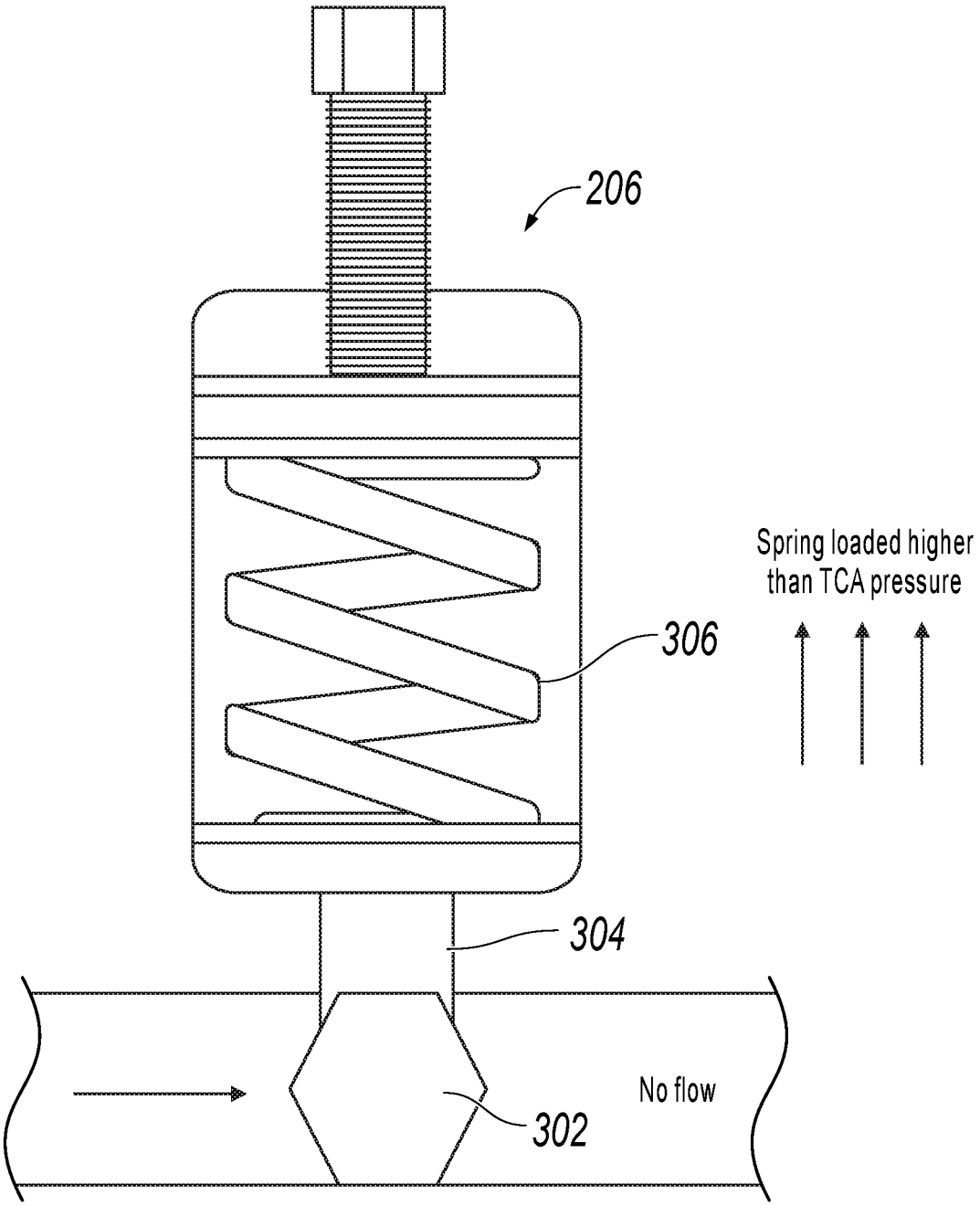
FIGS. 4A-4B are side, cross-sectional diagrams of an example poppet valve in various modes of operation.
Figure 4B:
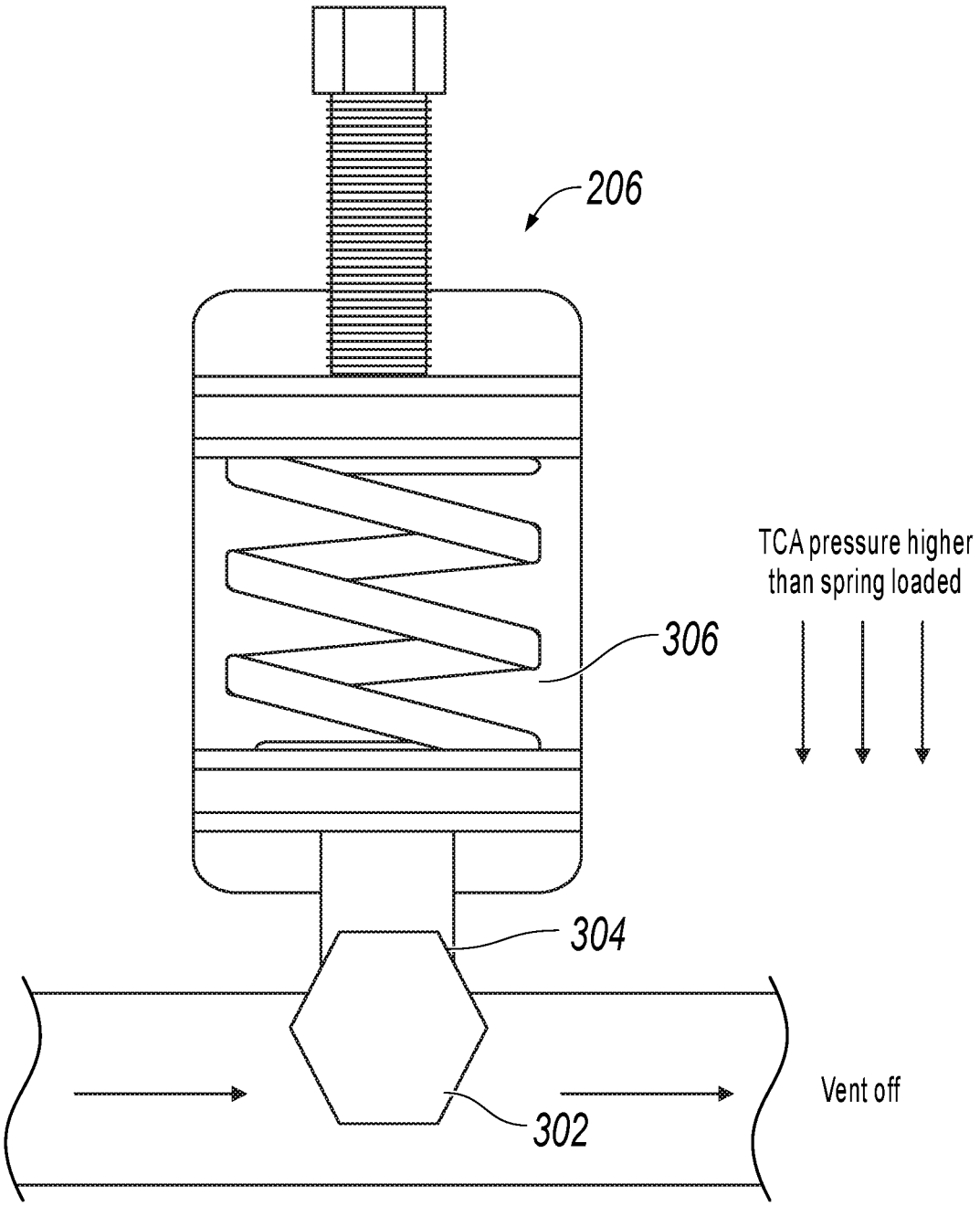

FIGS. 4A-4B are side, cross-sectional diagrams of an example poppet valve 206 in various modes of operation. In FIG. 4A, the valve is seated. That is, there is no flow going through the valve. As the pressure increases to the cracking pressure (for example, substantially 97% of the set pressure), the valve disk 302 lifts off the seat, moving the biased piston 304, and compressing the compression spring 306 to allow fluid flow through the valve 206, as shown in FIG. 4B. Once the pressure has fallen below the seating pressure (for example, substantially 90% of the set pressure), the valve disk 302 re-seats to block fluid flow. That is, the pressure drops below a threshold such that the compression spring 306 exerts force on the piston 304 and the valve disk 302 to seat the valve disk 302, returning the valve 206 to the state illustrated in FIG. 4A.

Figure 5:
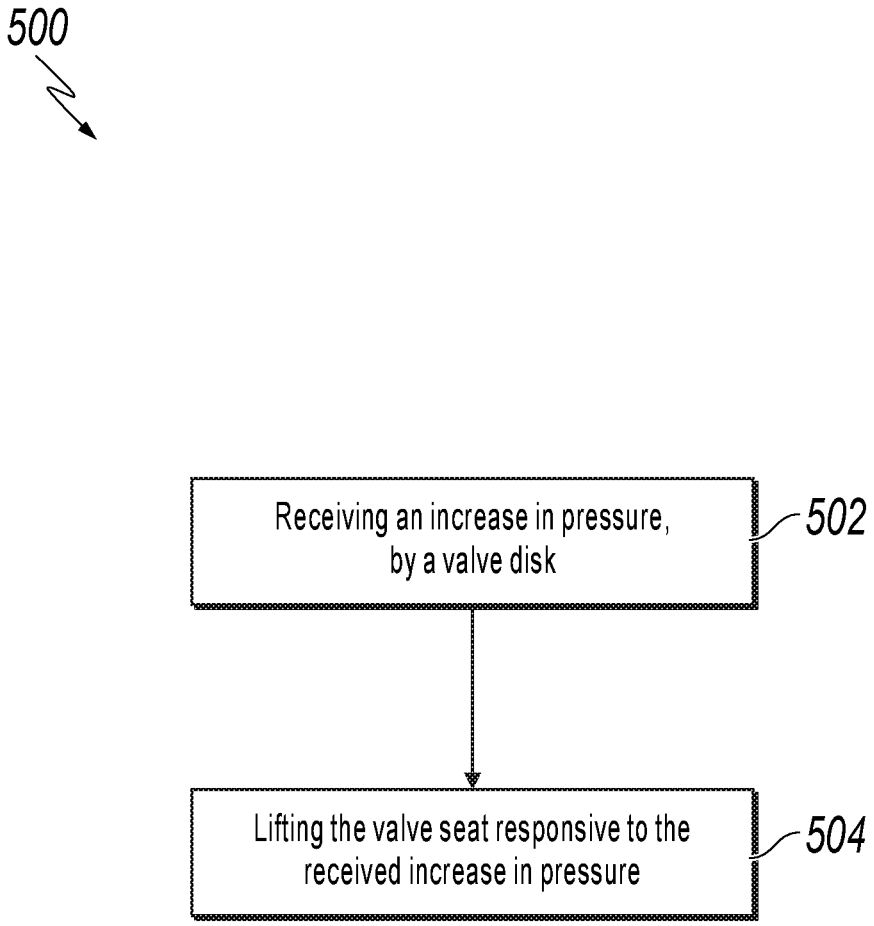
FIG. 5 is a flowchart of a method that can be used with aspects of this disclosure.

FIG. 5 is a flowchart of a method 500 that can be used with aspects of this disclosure. At 502, an increase in pressure is received by a valve disk 302 located within a fluid conduit 202 that defines a flow passage fluidically coupled to a well annulus 108. At 504, the valve disk 302 is lifted from the valve seat responsive to the received increase in pressure. After the valve disk 302 has lifted, pressure is communicated through the first PSV 206*a* to a second PSV 206*b*. A valve disk 302 of a second PSV 206*b* is lifted responsive to the communicated pressure.

Once the pressure is relieved, the valve disk 302 of the second PSV 206*b* is seated in response to a decreased pressure, followed by seating the valve disk 302 of the first PSV 206*a*. In some instances, such as where only the first valve disk 302 lifts, pressure can be reduced within the fluid conduit by manually venting the fluid conduit, for example, by a manual or actuated valve. In such an instance, an operator can manually relieve the pressure in person via a manual valve, or an operator can actuate an actuable valve from a remote control room. In some implementations, a controller can receive a signal indicative of the increased pressure from a pressure sensor, and the controller can autonomously open an actuable valve with no user input.

While this disclosure contains many specific implementation details, these should not be construed as limitations on the scope of what may be claimed, but rather as descriptions of features specific to particular implementations of particular inventions. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple software.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A pressure relief system comprising:

a linear fluid conduit defining a fluid passage from a well annulus to a venting system;

a first pressure safety valve positioned within the fluid passage, the first pressure safety valve comprising:

a first piston that extends perpendicularly with respect to the linear fluid conduit, and a first valve disk that extends axially from the first piston into the linear fluid conduit, wherein the first pressure safety valve is configured to open at a first set pressure that acts directly on the first valve disk to move the first valve disk out of the linear fluid conduit; and a second pressure safety valve positioned within the fluid passage, fluidically connected in series with the first pressure safety valve, and comprising:

a second piston that extends perpendicularly with respect to the linear fluid conduit, and a second valve disk that extends axially from the second piston into the linear fluid conduit, wherein the second pressure safety valve is configured to open at a second set pressure that acts directly on the second valve disk to move the second valve disk out of the linear fluid conduit, and wherein the second set pressure is greater than the first set pressure.

2. The pressure relief system of claim 1, wherein the first set pressure is substantially 1200 pounds per square inch gauge pressure and the second set pressure is substantially 1250 pounds per square inch gauge pressure.

3. The pressure relief system of claim 1, wherein the first pressure safety valve or the second pressure safety valve is a poppet style safety valve.

4. The pressure relief system of claim 1, wherein a cracking pressure of the first pressure safety valve and the second pressure safety valve are at substantially 97% of the first set pressure and the second pressure safety valve respectively.

5. The pressure relief system of claim 1, wherein a seating pressure of the first pressure safety valve and the second pressure safety valve are at substantially 90% of the first set pressure and the second pressure safety valve respectively.

6. A method comprising:

providing a first pressure safety valve within a flow passage defined by a linear fluid conduit, the flow passage being coupled to a well annulus, and the first pressure safety valve comprising:

a first piston that extends perpendicularly with respect to the linear fluid conduit, and a first valve disk that extends axially from the first piston into the linear fluid conduit;

providing a second pressure safety valve in fluid connection and in series with the first pressure safety valve within the flow passage, the second pressure safety valve comprising:

a second piston that extends perpendicularly with respect to the linear fluid conduit, and a second valve disk that extends axially from the second piston into the linear fluid conduit;

flowing a fluid within the flow passage to exert a first pressure directly on the first valve disk, lifting the first valve disk out of the linear fluid conduit in response to the first pressure;

communicating the fluid through the first pressure safety valve to the second safety valve to exert a second pressure directly on the second valve disk; and lifting the second valve disk out of the linear fluid conduit in response to the second pressure, the second pressure being greater than the first pressure.

7. The method of claim 6, further comprising:

seating the first valve disk of the first pressure safety valve in response to a decreased pressure.

8. The method of claim 6, further comprising:

seating the second valve disk of the second pressure safety valve in response to a decreased pressure.

9. The method of claim 6, further comprising:

reducing a pressure within the linear fluid conduit by manually venting the linear fluid conduit by a manual or actuated valve.

10. A system comprising:

a wellbore comprising an annulus defined by a wellbore casing and production tubing; and a safe venting system comprising:

a linear fluid conduit defining a fluid passage from the well annulus to a venting system;

a first poppet-style pressure safety valve positioned within the fluid passage, the first poppet-style pressure safety valve comprising:

a first piston that extends perpendicularly with respect to the linear fluid conduit, and a first valve disk that extends axially from the first piston into the linear fluid conduit, wherein the first poppet-style pressure safety valve is configured to open at a first set pressure that acts directly on the first valve disk to move the first valve disk out of the linear fluid conduit; and a second poppet-style pressure safety valve positioned within the fluid passage, fluidically connected in series with the first poppet-style pressure safety valve, and comprising:

a second piston that extends perpendicularly with respect to the linear fluid conduit, and a second valve disk that extends axially from the second piston into the linear fluid conduit, wherein the second pressure safety valve is configured to open at a second set pressure that acts directly on the second valve disk to move the second valve disk out of the linear fluid conduit, wherein the second set pressure is greater than the first set pressure.

11. The system of claim 10, wherein a cracking pressure of the first poppet-style pressure safety valve is at substantially 97% of the first set pressure.

12. The system of claim 10, wherein a seating pressure of the first poppet-style pressure safety valve is at substantially 90% of the first set pressure.

13. The system of claim 10, wherein a cracking pressure of the second poppet-style pressure safety valve is at substantially 97% of the second set pressure.

14. The system of claim 10, wherein a seating pressure of the second poppet-style pressure safety valve is at substantially 90% of the second set pressure.

15. The system of claim 10, further comprising an additional fluid conduit that directs fluid pressure from the first poppet-style pressure safety valve to a closed venting system.

16. The system of claim 10, further comprising an additional fluid conduit that directs fluid pressure from the first poppet-style pressure safety valve to an open venting system.

* * * * *